United States Patent [19]

Searfass

[11] Patent Number: 4,820,571

[45] Date of Patent: Apr. 11, 1989

[54] HIGH TEMPERATURE INDUSTRIAL FABRICS

[75] Inventor: Harry I. Searfass, Wayne, Pa.

[73] Assignee: Asten Group, Inc., Charleston, S.C.

[21] Appl. No.: 513,047

[22] Filed: Jul. 12, 1983

[51] Int. Cl.[4] ..... B32B 5/06

[52] U.S. Cl. ..... 428/225; 139/383 R; 139/420 A; 428/245; 428/257; 428/259

[58] Field of Search ..... 428/224, 225, 257, 258, 428/911, 524, 245, 259; 139/420 R, 383 H, 425 A, 383 R, 420 A; 528/125, 174; 264/176 F

[56] References Cited

U.S. PATENT DOCUMENTS

| | | | |
|---|---|---|---|
| 400,579 | 4/1889 | Maddox . | |
| 1,991,366 | 2/1935 | Barrell | 139/410 |
| 2,091,926 | 8/1937 | Hill | 139/420 |
| 2,208,090 | 7/1940 | Whittier | 139/408 |
| 2,992,469 | 7/1961 | Hose et al. | 28/75 |
| 3,279,504 | 10/1966 | Wagner | 139/419 |
| 3,751,398 | 8/1973 | Dahl | 260/47 R |
| 3,858,623 | 1/1975 | Lefkowitz | 139/425 |
| 3,915,202 | 10/1975 | Curtis et al. | 139/425 |
| 4,070,519 | 1/1978 | Lefkowitz et al. | 428/235 |
| 4,105,495 | 8/1978 | Pai | 162/348 |
| 4,149,571 | 4/1979 | Burroughs | 139/383 |
| 4,159,618 | 7/1979 | Sokaris | 57/251 |
| 4,186,262 | 1/1980 | Freeman et al. | 528/125 |
| 4,359,501 | 11/1982 | Ditullio | 428/245 |
| 4,395,308 | 7/1983 | Dawes | 162/232 |

FOREIGN PATENT DOCUMENTS

| | | |
|---|---|---|
| 1383393 | 2/1975 | United Kingdom . |
| 1387303 | 3/1975 | United Kingdom . |
| 1388013 | 3/1975 | United Kingdom . |

OTHER PUBLICATIONS

Publication entitled "New High Temperature Continuous Ceramic Fibers" by Donald D. Johnson, frontispiece, pg. iv & pgs. 164–180.

Provisional Data Sheet, ICI Plastics Division, entitled Polyetheretherketone, dated Nov., 1979.

Research Disclosure, dated May, 1979, p. 242, No. 18 127.

Swiss Plastics article entitled Polyetheretherketone (PEEK), A New High Performance Thermoplastic, C. P. Smith, Nov., 1980.

Polyaryletherketone: High Performance in a New Thermoplastic by T. C./ Stening, C. P. Smith and P. J. Kimber, Modern Plastics, Nov., 1981, pp. 86, 87 and 89.

Textile Terms and Definitions, Seventh Edition, The Textile Institute, 1975, frontispiece, preface, contents, pp. 42, 76–79, 127, 227–228.

Refrasil Product Data Bulletin Cordage and Yarn, dated Dec., 1975.

Refrasil Application Bulletin R-2/3, dated Feb., 1979.

Hitco Refrasil Non-Asbestos Textiles Technical Data Bulletin, dated May., 1981, replaces '79 edition.

Refrasil Product Data Bulletin Cloth, dated Oct., 1979.

Refrasil Product Data Bulletin Batt & Fiber, dated May., 1980.

Refrasil Product Data Bulletin "Irish", dated May., 1980.

Refrasil Product Data Bulletin AR100 Series Cloth, dated May, 1980.

Hitco Refrasil Non-Asbestos Textiles Technical Data Bulletin, dated May, 1981.

Hitco Refrasil Non-Asbestos Textiles Application Bulletin, dated Nov, 1981.

Hitco AR Series Refrasil Non-Asbestos Textiles Product Data Bulletin, dated Feb., 1981, reprint of '82.

Nextel 312, Ceramic Fiber Products by 3M, Apr. 1, 1980.

(List continued on next page.)

*Primary Examiner*—Marion C. McCamish

*Attorney, Agent, or Firm*—Volpe and Koenig

[57] ABSTRACT

An industrial fabric of woven monofilament threads comprised of a melt extrudable polyaryletherketone having improved high temperature resistance and hydrolysis resistance at elevated temperatures, such fabric exhibiting a high modulus of elongation making it particularly suitable for high temperature-high speed conveying applications in various industrial processing.

40 Claims, 1 Drawing Sheet

OTHER PUBLICATIONS

Booklet entitled Nextel 312 Ceramic Fiber from 3M, Donald D. Johnson Introduction, 283–296. Reprinted from Journal of Coated Fabrics, vol. 11 (Apr., 1981). Presented at the 67th Annual Convention, Canvas Products Association International, Toronto, Canada, 11/16/79.

Attwood et al., Synthesis and Properties of Polyaryletherketones, Polymer, vol. 22, Aug. 1981, pp. 1096–1103.

Attwood et al., Synthesis and Properties of Polyaryletherketones, ACS Polymer Preprints, vol. 20, No. 1, Apr. 1979, pp. 191–194.

EPO patent application 78300314.8, filed Aug. 22, 1978, published May 16, 1979, entitled Thermoplastic Aromatic Polyetherketones, etc.

ICI Research Disclosure of May 1979, disclosure No. 18127 at p. 242.

A group of three ICI Plastics Division Provisional Data Sheets of Nov., 1979 on polyetherketone.

HIGH TEMPERATURE INDUSTRIAL FABRICS

BACKGROUND OF THE INVENTION

1. Field of the Invention

The field of the present invention is woven fabrics of synthetic materials for the use under high temperature conditions as may be encountered in papermaking and other industrial processes.

2. Description of the Prior Art

Woven fabrics fashioned into endless belts for conveying and guiding products under manufacture are used in various industrial processes. Both metal and synthetic materials have been used for these belts but numerous processes involve high temperature and high moisture conditions which other synthetic materials cannot withstand. One prior art solution was the use of metallic thread materials, such as fine wires of brass, bronze or steel. The metallic wires are woven to form a flat fabric and then seamed at the fabric ends to form endless belts. Steels can withstand temperatures up to about 1000° F. (538° C.), and the brasses and brass alloys can be used for temperatures up to about 600° to 700° F. (316° to 371° C.). Metal fabrics, generally, are often difficult to handle, do not wear well, have poor flexure resistance and are prone to damage. They may also chemically interact with the product being conveyed, or can readily corrode under adverse environments. Thus, metal fabrics have had severe limitations.

Two synthetic materials that have found some use in high temperature applications are polymers known by the Trademarks Nomex and Kevlar, as reported in U.S. Pat. No. 4,159,618 and available from the DuPont Company. These materials are twisted from multifilaments, or staple fibers into yarns, and are not available for applications where monofilament threads are preferred. Having a relatively rough, porous surface a multifilament can be difficult to keep clean in applications where contaminants are a problem, and for this reason Nomex and Kevlar yarns are sometimes coated with suitable resins to simulate monofilaments. These composite yarns can be woven or knitted into fabrics useful in such applications as conveying belts for dryer sections of a paper machine, where elevated temperatures are frequently encountered. However, under extended high temperature exposure, dry or moist, there can be a severe loss in tensile strength, as further reported in said patent.

Another synthetic material that is woven from monofilaments into fabrics for use as industrial conveying and guiding belts is polyester. It has gained widely accepted usage in the forming, press and dryer sections of papermaking machines because of its abrasion resistance, ability to flex, dimensional stability after being thermoset, chemical inertness, and ease of handling. Over the years techniques have been developed for weaving, thermosetting and seaming polyester threads and fabrics, so that this material can be readily handled in the manufacture of endless belts. Polyester consequently enjoys wide acceptance; however, this material has poor high temperature hydrolytic stability, and cannot be satisfactorily used under moist conditions at continuous elevated temperatures. In papermaking applications, for example, it can be a limiting factor for the temperatures under which drying processes can be carried out, and where high temperatures are desired some other thread material must be resorted to. As a result of the lower temperatures necessary to preserve the fabric, the drying equipment must operate at lower speeds to achieve the necessary driness. The lower speed translates into lower production and higher production cost per ton.

In other manufacturing processes, such as in continuous drying or curing ovens for heat treating a product, it is advantageous to employ conveying belts that can withstand high temperature and moisture conditions for the processing. In some installations coarsely woven metal belts, or belts constructed of metal links may be satisfactory, but where high speed operation or other criteria dictates a different belt material, there has not been a satisfactory answer for meeting belt requirements in high temperature applications. The present invention provides a solution to these prior art problems.

SUMMARY OF THE INVENTION

The invention herein resides in the formation of a fabric that can be fashioned into industrial belts using known manufacturing techniques. The resultant belts that have improved high temperature characteristics and hydrolysis resistance in order to withstand hot environments that are either moist or dry. Additionally, the resultant belts are useful in high speed processes such as those encountered in papermakers through-air dryers.

The fabrics of the present invention have interwoven warp and shute thread systems in which one or both of the thread systems include monofilaments of polyaryletherketone polymers. The polyaryletherketones can be extruded into monofilament threads and then woven and heat set to obtain a fabric having good wear qualities, adequate flexibility for moving across and around machine elements, chemical inertness and dimensional stability. One application for such fabrics is in dryer sections of papermaking machines, particularly through-air type dryers wherein a paper web supported and conveyed by the fabric is brought into contact with and drawn around the surface of a perforate drum that passes heated air through the paper web and the fabric to remove water from the web. Such through-air dryers operate under temperature and moisture conditions which tax the ability of polyester and other synthetic fabrics to maintain their physical characteristics, particularly hydrolytic resistance. At over about 400° F. (204° C.), the mechanical properties of polyesters rapidly decline, so that they are no longer suitable for use. Therefore, when polyester fabrics are used, dryer temperatures and speeds must be regulated to keep within the permissible operating parameters of the polyester. The other synthetic materials, Nomex and Kevlar, may operate at higher temperatures, but they exhibit some problems as a result of their multifilament construction, as explained hereinabove.

Fabrics incorporating polyaryletherketone monofilaments can withstand continuous operating temperatures as high as 500° F. (260° C.) in the presence of a hydrolyzing media. This makes such fabrics highly advantageous for through-air dryer applications, and allows the paper drying operation to be carried out under more optimal conditions at increased temperatures and speeds. Fabrics woven from monofilaments of such material may also be employed in other processing where resistance to high temperature hydrolysis is a particularly important characteristic. Examples are belting for drying ovens, paper machine dryer section clothing, paper forming fabrics operating under hot, moist conditions including exposure to high pressure steam impingement, fabric for press-drying paper, and similar applications.

Fabrics incorporating polyaryletherketone monofilaments identified as polyetheretherketone having shown usefulness as high temperature high speed papermakers drier fabrics for use in through-air dryer applications.

It is an object of the invention to provide an industrial fabric of synthetic, polyaryletherketone material having improved high temperature and hydrolytic stability.

It is another object of the invention to provide a fabrics having such stability that includes polyaryletherketone thread material that can be woven and thermally set using known equipment and techniques in order to facilitate production of the fabric.

A further object is to provide such a fabric that in addition to exhibiting hydrolytic and thermal stability has other desired characteristics of dimensional stability, flexure, good abrasion resistance, and the like, so as to be suitable for a wide range of applications including high speed operation in papermaking machine.

A further object of the invention is to provide a fabric of polyetheretherketones that is suitable for high temperature-high speed applications such as through-air dryer applications for use in papermaking processes.

The foregoing and other objects and advantages of the invention will appear from the following description. In the description reference is made to the accompanying drawings which form a part hereof, and in which there is shown by way of illustration preferred embodiments of the invention. Such embodiments do not necessarily represent the full scope of the invention, however, and reference is made therefore to the claims herein for interpreting the scope of the invention.

DESCRIPTION OF THE PREFERRED EMBODIMENTS

Figure 1:
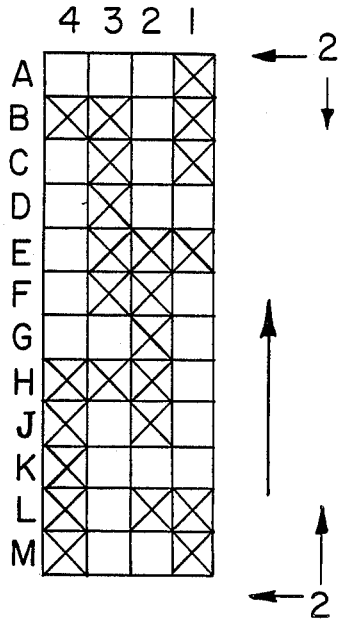
FIG. 1 is a weave chart for woven fabrics according to the invention, wherein the arrow indicates the direction of weaving.

Referring to FIG. 1 of the drawings, there is shown a weave chart for a two ply balanced weave fabric. The machine direction threads are represented by numerals 1 through 4 and the cross-machine direction threads are represented by letters A to M, the weave repeats on a 4×12 repeat pattern.

Figure 2:
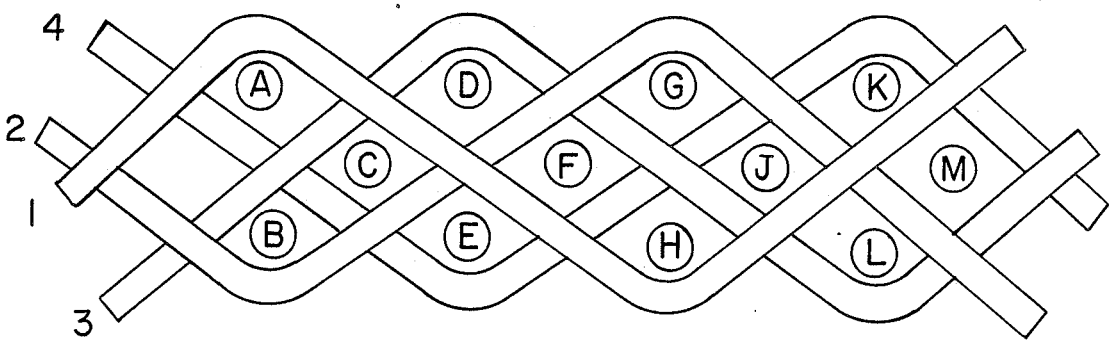
FIG. 2 is a section cut of the final fabric taken parallel to the direction of the warp in FIG. 1.

With reference to FIG. 2, there is shown a section cut parallel to the machine direction threads of the fabric woven according to the chart of FIG. 1. The fabric of FIG. 2 was designed to have a permeability of approximately 500 CFM. It will be recognized by those skilled in the art that different weave patterns may be utilized to achieve a different permeability and that stuffer yarns may also be utilized. Likewise, it will be appreciated from the description of the invention that single or multiply fabrics may be made in accordance with the invention.

All of the threads of the fabric woven as depicted in FIG. 2 were extruded monofilaments of polyetheretherketones. However, during testing it was determined the threads extruded from the class polyaryletherketones polymers could be utilized in fabrics exclusively or in combination with threads of other materials. However, due to the different weaving and heat setting characteristics of the various thread materials, it will be necessary to design the fabric with final finishing in mind. It may, in some applications, be advantagous to use such a combination of the art to achieve selected characteristics in the fabric profile. For example, the polyaryletherketone threads could be concentrated in the selvage area to prevent early degradation of the selvage. Additionally, it has been found that it is preferrable to use all polyaryletherketone threads in the cross machine direction in mixed thread fabrics. This is preferred to using mixed threads in the cross machine direction with all polyaryetherketone threads in the machine direction. Experiences, although limited, have indicated that fabric heat setting and finishing are accomplished with fabrics having all polyaryletherketone cross machine direction yarns. The best advantage appears to be achieved by a fabric woven entirely of polyaryletherketone threads but due to the relative high cost of the polyaryletheketone raw material, selective use may be more practical from an ecomonic view point. The polyaryletherketone fabric becomes economically practical when the application calls for a high temperature, high moisture, high speed environment. Under these conditions, the added fabric life of the fabric combined with increased production time per fabric change over and increased production speed combine to justify the additional cost associated with the polyaryletherketone polymers.

A fabric of the weave and pattern shown in FIG. 1 was woven flat on a loom in a mesh count of 72 warp threads or ends per inch at the reed with both warp and shute or filling threads having a nominal diameter of 0.016 inch. After weaving, the fabric was thermally set under heat and tension. The weaving and heat setting techniques followed known procedures for manufacturing fabrics from other synthetic materials, namely forming the fabric into an endless belt by use of a temporary seam and holding the fabric in tension while heating it to a preselected temperature as it is run over a set of cylinder or rolls. The heat setting temperature, however, was higher than normally used for other materials, such as polyester. A temperature range of 450° F. to 550° F. has been used, but this is exemplary only and other temperatures, as well as variations in tensions and time may be used in the heat setting process to produce desired thread counts and knuckle formation, much the same as for other fabric materials. As noted a temperature range of 450° F. to 550° F. has been used with tension being approximately 3 PLI and multiple passes of approximately three minutes each.

Since the fabric 1 was woven flat, it was fashioned into an endless belt after heat setting by cutting to size, if necessary, and joining the fabric ends with a permanent looped pin seam using the same thread material for the pin. The final sizing and seaming operation will be familiar to those skilled in the art.

Polyaryletherketone polymers suitable as the monofilament threads in the fabrics of this invention are polyetheretherketones having the repeating unit

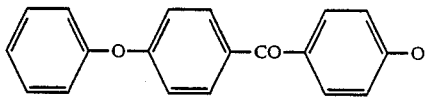

identified in the claims as —ϕ—O—ϕ—CO—ϕ—O such as polyetheretherketone prepared by nucleophilic polycondensation of bis-difluorobenzophenone and the potassium salt of hydroquinone. A detailed explanation for preparation of polyetherketones having the above identified repeat unit may be found in EPO application No. 78300314.8 filed on Aug. 22, 1978 and published on July 16, 1979.

Other polyaryletherketones polymers which appear suitable for monofilament threads in fabrics according to the invention are those having either of the following repeat units:

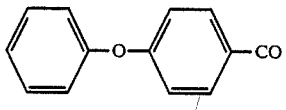

identified in the claims as —ϕ—O—ϕ—CO— and

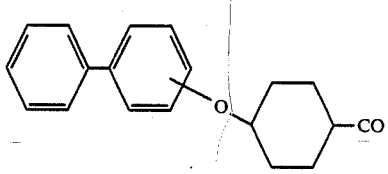

identified in the claims as —ϕ—ϕ—O—ϕ—CO— which are described in more detail in U.S. Pat. No. 3,751,398 and ICI Research Disclosure of May, 1979, No. 18127 at page 242. According to the above referenced ICI disclosure, there were problems encountered lubricant with the polyetherketone. Thus before processing, the polyetherketone is dusted with the calcium stearate e.g. by dry tumbling. The best level of calcium stearate to use may be found by experiment but we have found 0.1%-0.2% particularly about 0.5% (based on the weight of the polyetherketone) to be satisfactory. While calcium stearate is a well-known lubricant for many polymers, its successful use under the present circumstances is somewhat surprising in view of the very high processing temperatures employed; one might have expected calcium stearate to decompose or degrad at such temperatures or at any rate be rendered inactive."

Polyaryletherketone resins of the foregoing types are commercially available from several companies, including Raychem Corporation and Imperial Chemical Industries Limited. Suitable techniques for their preparation are described in Attwood et al, Synthesis and Properties of Polyaryletherketones, *Polymer,* Vol. 22, August 1981, pp. 1096-1103; Attwood et al, Synthesis and Properties of Polyaryletherketones, *ACS Polymer Preprints,* Vol. 20, No. 1, April 1979, pp. 191-194; and EPO published application Ser. No. 783003148, Thermoplastic aromatic Polyetherketones etc. See also U.S. Pat. Nos. 3,751,398 and 4,186,262 and British Pat Nos. 1,383,393, 1,387,303 and 1,388,013. Some data with respect to extruding high temperature polyaryletherketones may be found in ICI Research Disclosure of May, 1979, No. 18127 at page 242. The disclosures of the foregoing are incorporated herein by reference. Briefly, the resins may be prepared by Friedel-Crafts condensation polymerization of appropriate monomers using a suitable catalyst such as boron trifluoride. The polyarylethereketone resins suitable for the practice of this invention are to be melt extrudable, i.e. they should have appropriate molecular weights and intrinsic viscosities so as to be capable of extrusion into monofilament form.

In extruding the polyetheretherketone (PEEK) monofilaments used in the fabric according to the invention, it was found that a lubricant, as previously suggested, was not necessary for proper extrusion. In extruding, the temperature profile of the several extruder zones have been heated to approximately 390° C. (734° F.) for the initial extruding, and as flow begins temperatures were reduced to 350° C. (662° F.) in the feed zone, 380° C. (716° F.) in the transition zone and metering zone, and 370° C. (698° F.) in the die zone. Spinerettes have been used like those for other extrusions, to produce a monofilament of a final 0.016 inch nominal diameter. Various filament sizes can be obtained by adjusting screw, pump and pull roll speeds, and final thread sizing is made in a subsequent drawing operation. ICI Provisional Data Sheet of November, 1979, Ref. No. PK PD9, in providing some drawing data indicates a draw ratio of 2.8:1.

The polyaryletherketones exhibit excellent retention of tensile strength at temperatures up to at least 500° F. (260° C.). The polyetheretherketones and the polyetherketones have similar characteristics. For example, the melting point of a typical polyetheretherketone of 334° C. (633° F.) compares with 365° C. (689° F.) for a typical polyetherketone, and the glass transition temperatures are respectively 143° C. (289° F.) and 165° C. (329° F.).

The polyaryletherketones also have a modulus of elasticity higher than PET polyester and a greater retention of tensile strength with increase in temperature. Such characteristics indicate good qualities for finished fabrics, and these materials also exhibit adequate flexibility for use where flexure for travel around conveyor, or machine rolls is a requisite factor.

Fabrics woven of monofilament polyaryletherketones have also exhibited desirable characteristics for conveying belts, such as may be useful in single layer fabrics. Such single layer fabrics are used in the papermaking process both in the forming and drying areas. These fabrics may have relatively open meshes, having as high as a 40% open area for single layer fabrics. Where thread counts are increased and thread diameters correspondingly reduced, the total bulk of thread materials may be lessened. Due to the high modulus of elongation achieved with these fabrics they are suitable for paper manufacture and other uses where fabric elongation must be controlled within narrow limits. In particular, for use on papermaking machines, open areas of single layer fabrics typically range between 15% to 40% of total fabric area. Such values of open area of fabrics of the invention are particularly suitable for paper manufacture.

With one fabric which was constructed of polyetheretherketone, a 72 hours hydrolysis test sample exposed at 260° F. and 20 pounds per square inch showed no loss in tensile strength for either machine or cross machine direction. A polyester test sample woven in the same pattern under the test conditions showed a loss of 47% for the machine direction and a loss of 34.3% for the cross machine direction. Under acidic conditions the fabric had similar test results. Under caustic conditions the polyetherketone were substantially better at retaining the tensile strength. The polyetheretherketone showed zero loss in machine direction and 6.9% loss in cross machine direction which compared to 15.6% and 18.1% respectively.

With respect to fabric modulus, it will be recognized by those skilled in the art that modulus is related to the temperature and load applied during heat setting. It has been found that polyaryletherketone fabrics can be heat set in accordance with the time and load used for polyester fabrics and an associated increase temperature. The resulting fabric modulus will be comparable to that achieved in the polyester fabric and the fabric will be equipment compatible; however, it will have better high temperature and hydrolysis resistance.

Woven fabrics of the invention have also shown desirable characteristics at elevated temperatures, in addition to having hydrolytic resistance. The modulus of elongation at temperatures up to 400° F. (204° C.) has been comparable to that of fabrics of other materials, the tendency to shrink at elevated temperatures up to 400° F. (204° C.) has been less than other fabrics, and when under tension loading the internal stress of a fabric at elevated temperatures has been less than for comparable fabrics of other material. Thus, the invention provides in a fabric the combination of hydrolytic resistance with desirable characteristics of good modulus, little tendency to shrink and superior low stress at elevated temperatures of at least 400° F. (204° C.)

The invention thus provides an industrial fabric of high heat resistance in dry or moist conditions without material loss in tensile strength, making use of synthetic melt extrudable polyaryletherketone resinous materials. While the fabric examples of FIGS. 1 and 2 are comprised of polyaryletherketones for both warp and shute threads, it is within the scope of the invention to combine these threads of other materials where desired. Fabrics utilizing the invention may also be of single layer or multi-layer construction, and the threads can be metalized or coated with resins or other compounds to produce specific surface characteristics.

I claim:

1. A papermaker's fabric having machine direction and cross machine direction threads interwoven with one another in a repeated pattern and finished into an endless belt with the threads of the belt being thermally set after weaving to stabilize the fabric, wherein certain of the threads are monofilaments of a melt extrudable polyaryletherketone selected from the group consisting of polyetherketones having repeating units of —ϕ—O—ϕ—CO—, —ϕ—O—ϕ—CO— and/or —ϕ—O—ϕ—CO—ϕ—O—.

2. A papermaker's dryer fabric comprised of machine direction and cross machine direction threads interwoven with one another in a repeated pattern and thermally set after weaving to stabilize the fabric with a fabric open area between the range of more than 10% but less than 40% of the total fabric area, wherein certain of said threads are monofilaments of a melt extrudable polyaryletherketone consisting essentially of polyetheretherketone having repeat units of —ϕ—O—ϕ—CO—ϕ—O—.

3. The fabric of claim 2, wherein said machine direction threads have a nominal diameter of 0.016 inches.

4. The fabric of claim 3 wherein said cross machine direction yarns have a normal diameter of 0.016 inches.

5. The fabric of claim 2 wherein said fabric is flat woven with a mesh count of 72 warp threads per inch at the reed.

6. The fabric of claim 5 wherein said machine direction threads have a normal diameter of 0.016 inches.

7. The fabric of claim 6 wherein said cross machine direction yarns have a nominal diameter of 0.016 inches.

8. The fabric of claim 2 wherein said monofilament threads have a thermal resistance of 90% retention of tensile strength after exposure to temperatures of up to 500° F.

9. The fabric of claim 2, wherein said fabric is a single layer fabric.

10. The fabric of claim 9 wherein said fabric has an open area between the range of 15 to 40 percent of total fabric area.

11. The fabric of claim 10 wherein said fabric has a hydrolysis resistance of maintaining substantially all of its initial tensile strength after exposure to moist heat of about 260° F. at 20 pounds per square inch for at least 72 hours.

12. The fabric of claim 11 wherein said fabric has a caustic resistance of maintaining at least 90 percent of the initial tensile strength.

13. The fabric of claim 2 wherein said fabric is at least a two ply fabric.

14. The fabric of claim 13 wherein said fabric has a hydrolysis resistance of maintaining substantially all of its initial tensile strength after exposure to moist heat of about 260° F. at 20 pounds per square inch for at least 72 hours.

15. The fabric of claim 14 wherein said fabric has a caustic resistance of maintaining at least 90 percent of the initial tensile strength.

16. The fabric according to claim 15 wherein said two ply weave is a balanced weave.

17. The fabric of claim 2 wherein said machine direction threads have a nominal diameter of 0.016 inches.

18. The fabric of claim 17 wherein said cross machine direction yarns have a nominal diameter of 0.016 inches.

19. The fabric of claim 2 wherein said threads of the belt are thermally set at a temperature greater than 400° F.

20. A papermaker's dryer fabric having machine direction and cross machine direction threads interwoven with one another in a repeated pattern and finished into an endless belt with the threads of the belt being thermally set after weaving to stabilize the fabric, wherein certain of the threads are of polyetheretherketone having hydrolysis resistance of maintaining at least 90% of the initial tensile strength after exposure to moist heat of 260° F. at 20 pounds per square inch for at least 72 hours.

21. A papermaker's dryer fabric belt having machine direction and cross machine threads interwoven in a repeated pattern, wherein certain of the threads are of polyetheretherketone having repeating units essentially of —ϕ—O—ϕ—CO—ϕ—O.

22. A papermaker's dryer fabric comprised of machine direction and cross machine direction threads interwoven with one another in a repeated pattern and finished into an endless belt with the threads of the belt being thermally set after weaving to stabilize the fabric, wherein all of said threads are monofilaments of a melt extrudable polyaryletherketone consisting essentially of repeat units of —ϕ—O—ϕ—CO—ϕ—O—.

23. The fabric of claim 22, wherein said machine direction threads have a nominal diameter of 0.016 inches.

24. The fabric of claim 23 wherein said cross machine direction yarns have a nominal diameter of 0.016 inches.

25. The fabric of claim 22 wherein said fabric is flat woven with a mesh count of 72 wrap threads per inch at the reed.

26. The fabric of claim 25 wherein said machine direction threads have a nominal diameter of 0.016 inches.

27. The fabric of claim 26 wherein said cross machine direction yarns have a nominal diameter of 0.016 inches.

28. The fabric of claim 22 wherein said monofilament threads have a hydrolysis resistance of maintaining at least 90% of the initial tensile strength after exposure to heat of 260°F. at 20 pounds per square inch for at least 72 hours.

29. The fabric of claim 28 wherein said machine direction threads have a nominal diameter of 0.016 inches.

30. The fabric of claim 29 wherein said cross machine direction yarns have a nominal diameter of 0.016 inches.

31. The fabric of claim 22 wherein said monofilament threads have a thermal resistance of 90% retention of tensile strength after exposure to temperature of up to 500°F.

32. The fabric of claim 22, wherein said fabric is a single layer fabric.

33. The fabric of claim 32 wherein said fabric has an open area between the range of 15 to 40 percent of total fabric area.

34. The fabric of claim 33 wherein said fabric has a hydrolysis resistance of maintaining substantially all of its initial tensile strength after exposure to moist heat of about 260°F. at 20 pounds per square inch for at least 72 hours.

35. The fabric of claim 34 wherein said fabric has a caustic resistance of maintaining at least 90 percent of the initial tensile strength.

36. The fabric of claim 22 wherein said fabric is at least a two ply fabric.

37. The fabric of claim 36 wherein said fabric has a hydrolysis resistance of maintaining substantially all of its initial tensile strength after exposure to moist heat of about 260°F. at 20 pounds per square inch for at least 72 hours.

38. The fabric of claim 37 wherein said fabric has a caustic resistance of maintaining at least 90 percent of the initial tensile strength.

39. The fabric according to claim 38 wherein said two ply weave is a balanced weave.

40. A papermaker's dryer fabric belt having machine direction and cross machine direction threads interwoven in a repeated pattern with the threads of the belt being thermally set after weaving to stabilize the fabrics, wherein all of the interwoven threads are monofilaments of polyetheretherketone having repeating units of —ϕ—O—ϕ—CO—ϕ—O—.

* * * * *

UNITED STATES PATENT AND TRADEMARK OFFICE

CERTIFICATE OF CORRECTION

PATENT NO. : 4,820,571

DATED : April 11, 1989

INVENTOR(S) : Harry I. Searfass

It is certified that error appears in the above-identified patent and that said Letters Patent is hereby corrected as shown below:

Column 1, line 7, delete the word "the".

Column 3, line 13, delete the word "fabrics" and insert therefor --fabric--.

Column 5, line 33, before the word "Thus", insert --"---.

Column 5, line 37, delete the "0.5%" and insert therefor --0.15%--.

Column 5, line 66, delete the word "polyarylether-eketone" and insert therefor --polyaryletherketone--.

Column 7, claim 1, line 47, delete "-ϕ-O-ϕ-CO-" and insert therefor -- -ϕ-ϕ-O-ϕ-CO- --.

Column 7, claim 4, line 63, delete "normal" and insert therefor --nominal--.

Column 7, claim 6, line 68, delete "normal" and insert therefor --nominal--.

Column 8, claim 17, line 32, delete the numeral "2" and insert therefor --20--.

Column 8, claim 19, line 36, delete the numeral "2" and insert therefor --20--.

UNITED STATES PATENT AND TRADEMARK OFFICE

CERTIFICATE OF CORRECTION

PATENT NO. : 4,820,571

DATED : April 11, 1989

INVENTOR(S) : Harry I. Searfass

It is certified that error appears in the above-identified patent and that said Letters Patent is hereby corrected as shown below:

Column 8, claim 19, line 36, delete the numeral "2" and insert therefor --20--.

Signed and Sealed this

Twentieth Day of March, 1990

*Attest:*

JEFFREY M. SAMUELS

*Attesting Officer*

*Acting Commissioner of Patents and Trademarks*